US011653728B2

(12) United States Patent
Kalajian

(10) Patent No.: US 11,653,728 B2
(45) Date of Patent: May 23, 2023

(54) JEWELRY ITEM HAVING SETTINGS FOR SECURING A CENTER STONE AND SIDE STONES

(71) Applicant: Alec Kalajian, Houston, TX (US)

(72) Inventor: Alec Kalajian, Houston, TX (US)

( * ) Notice: Subject to any disclaimer, the term of this patent is extended or adjusted under 35 U.S.C. 154(b) by 51 days.

(21) Appl. No.: 17/318,258

(22) Filed: May 12, 2021

(65) Prior Publication Data

US 2022/0361635 A1 Nov. 17, 2022

(51) Int. Cl.
*A44C 17/02* (2006.01)
*A44C 9/00* (2006.01)

(52) U.S. Cl.
CPC ..... *A44C 17/02* (2013.01); *A44C 9/00* (2013.01)

(58) Field of Classification Search
CPC ..... A44C 17/02; A44C 9/00
USPC ..... 63/26, 27, 28
See application file for complete search history.

(56) References Cited

U.S. PATENT DOCUMENTS

| | | | | |
|---|---|---|---|---|
| 6,619,378 | B1 * | 9/2003 | Gavin | B22D 25/026 164/24 |
| 9,351,546 | B2 * | 5/2016 | Nevatia | A44C 17/00 |
| 2017/0354210 | A1 * | 12/2017 | Artinger | A44C 27/00 |
| 2019/0343248 | A1 * | 11/2019 | Shah | A44C 17/02 |

* cited by examiner

*Primary Examiner* — Jack W Lavinder
(74) *Attorney, Agent, or Firm* — Jeffrey Streets; Madan Law PLLC

(57) ABSTRACT

A jewelry item includes a ring-shaped base, a single center setting and a plurality of side settings. The ring-shaped base has a central opening and a central axis. The single center setting has a plurality of primary prongs for securing a center stone. The plurality of side settings is configured for securing an equal plurality of side stones around a perimeter of the center setting, wherein each side setting includes first and second adjacent inner secondary prongs and first and second adjacent outer secondary prongs. The jewelry item may be a ring having a band to be worn about a finger of a person. Shoulders and struts may secure the ring-shaped base above the band.

20 Claims, 6 Drawing Sheets

JEWELRY ITEM HAVING SETTINGS FOR SECURING A CENTER STONE AND SIDE STONES

BACKGROUND

The present disclosure relates to a jewelry item for securing gemstones.

Background of the Related Art

Many types of jewelry include precious stones. The precious stone are secured in settings that prevent loss of the precious stones as well as display the precious stones in a manner that highlights their appearance. The configuration of the setting will determine the position of the stones and how much of the stone can be seen. For a stone that is translucent, the configuration of the setting can even affect how light passes through the stone.

BRIEF SUMMARY

Some embodiments provide a jewelry item comprising a ring-shaped base, a single center setting and a plurality of side settings. The ring-shaped base has a central opening and a central axis. The single center setting is configured for securing a center stone, wherein the single center setting includes a plurality of primary prongs. Each primary prong extends from the ring-shaped base at a first axial elevation and a first radial distance from the central axis, wherein the plurality of primary prongs are positioned to collectively secure the center stone in a position that intersects the central axis. The plurality of side settings is configured for securing an equal plurality of side stones around a perimeter of the center setting, wherein each side setting includes first and second adjacent inner secondary prongs and first and second adjacent outer secondary prongs. Each inner secondary prong extends from the ring-shaped base at a second axial elevation and a second radial distance from the central axis, and each outer secondary prong extends from the ring-shaped base at a third axial elevation and a third radial distance from the central axis. The first axial elevation is greater than the second axial elevation, and the second axial elevation is greater than the third axial elevation.

Some embodiments provide a jewelry item comprising a ring-shaped base, a single center setting, a center stone, a plurality of side settings, and a plurality of side stones. The ring-shaped base has a central opening and a central axis. The single center setting includes a plurality of primary prongs, each primary prong extending from the ring-shaped base at a first axial elevation and a first radial distance from the central axis. The center stone is secured in a position that intersects the central axis by the plurality of primary prongs, wherein the center stone has a pavilion that extends into the central opening. The plurality of side settings is positioned around a perimeter of the center setting, wherein each side setting includes first and second adjacent inner secondary prongs and first and second adjacent outer secondary prongs. Each inner secondary prong extends from the ring-shaped base at a second axial elevation and a second radial distance from the central axis, and each of the outer secondary prongs extending from the ring-shaped base at a third axial elevation and a third radial distance from the central axis. The first axial elevation is greater than the second axial elevation, and the second axial elevation is greater than the third axial elevation. The jewelry item further includes a plurality of side stones, wherein each side stone is secured in one of the side settings.

DETAILED DESCRIPTION

Figure 1A:
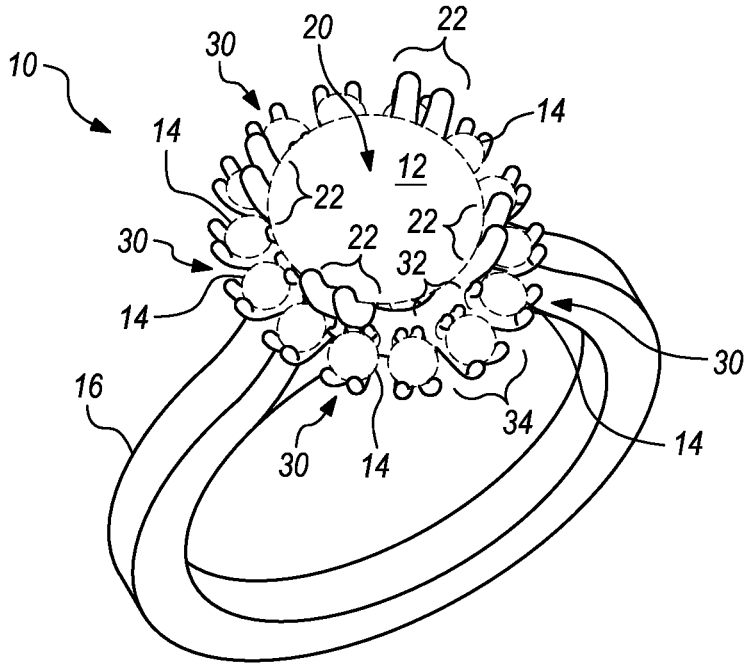
FIG. 1A is a perspective view of a jewelry item according to some embodiments, in the form of a ring.

Some embodiments provide a jewelry item comprising a ring-shaped base, a single center setting and a plurality of side settings. The ring-shaped base has a central opening and a central axis. The single center setting is configured for securing a center stone, wherein the single center setting includes a plurality of primary prongs. Each primary prong extends from the ring-shaped base at a first axial elevation and a first radial distance from the central axis, wherein the plurality of primary prongs are positioned to collectively secure the center stone in a position that intersects the central axis. The plurality of side settings is configured for securing an equal plurality of side stones around a perimeter of the center setting, wherein each side setting includes first and second adjacent inner secondary prongs and first and second adjacent outer secondary prongs. Each inner secondary prong extends from the ring-shaped base at a second axial elevation and a second radial distance from the central axis, and each outer secondary prong extends from the ring-shaped base at a third axial elevation and a third radial distance from the central axis. The first axial elevation is greater than the second axial elevation, and the second axial elevation is greater than the third axial elevation.

Some embodiments of the jewelry item may be made with metal, such as gold, platinum, palladium, silver, titanium, tungsten, or stainless steel. Other metals and/or other materials may also be used to make the jewelry item, including ceramics and composite materials. The jewelry item may be made using a casting process in which a molten metal is poured into a mold or may be made using a three-dimensional printing process. Other forming, polishing and finishing techniques may also be used alone or in combination with casting or three-dimensional printing. Furthermore, the jewelry item may be, or form part of, a brooch, ring, necklace, earring, pendant, bracelet, or cufflink, without limitation.

The ring-shaped base has a central opening, but the path of the ring-shaped base around the central opening may be that of a circle, oval, rectangle (including a square), polygon, irregular curve or some other shape. Furthermore, the cross-sectional shape or profile of the ring-shaped base may be a circle, oval, rectangle (including a square), polygon, irregular curve or some other shape, and the cross-sectional shape may change along the path of the base around the central opening. The ring-shaped base also has a central axis, which may be an axis of rotation (in the case of a circular base) or may be an axis that runs through the center of the central opening (in the case of non-circular bases). In some embodiments, the ring-shaped base is a toroidal shape, such as a toroidal shape having a circular, oval or rectangular cross-section profile in a radial plane relative to the central axis.

The single center setting is configured for securing a center stone, wherein the single center setting includes a plurality of primary prongs. The plurality of primary prongs preferably includes 3-4 prongs, but may include any number greater than three. Furthermore, the plurality of primary prongs may be positioned to collectively secure the center stone in a position that intersects the central axis.

The plurality of side settings is configured for securing an equal plurality of side stones around a perimeter of the single center setting. The number of side stones secured around the perimeter of the single center setting will vary based upon various factors, such as the shape of the center setting and/or center stone, the size of the center setting and/or center stone, the size of the side settings and/or side stones. Each side setting includes first and second adjacent inner secondary prongs and first and second adjacent outer secondary prongs. In some embodiments, the plurality of side settings is arranged to secure a plurality of side stones in a halo configuration about the plurality of primary prongs that collectively secure the center stone.

Each primary prong extends from the ring-shaped base at a first axial elevation and a first radial distance from the central axis, each inner secondary prong extends from the ring-shaped base at a second axial elevation and a second radial distance from the central axis, and each outer secondary prong extends from the ring-shaped base at a third axial elevation and a third radial distance from the central axis. Accordingly, the primary prongs may be disposed in a first row around the ring-shaped base, the inner secondary prongs may be disposed in a second row around the ring-shaped base, and the outer secondary prongs may be disposed in a third row around the ring-shaped base. The first axial elevation is preferably greater than the second axial elevation, and the second axial elevation is preferably greater than the third axial elevation. In addition, the first radial distance is preferably less than both of the second radial distance and the third radial distance. In other words, the primary prongs may be generally on top of the ring-shaped base and may be closer to the central axis than any of the inner and outer secondary prongs. The inner and outer secondary prongs may be disposed on the ring-shaped base at points that are further away from the central axis (i.e., have a greater radial distance from the central axis) than are the primary prongs and that may be lower (i.e., the axial distance is less) than the primary prongs.

In some embodiments, each of the primary prongs may have a groove positioned for receiving a portion of a girdle of the center stone, and each of the inner secondary prongs and each of the outer secondary prongs may have a groove for receiving a portion of a girdle of one of the side stones. With three or more prongs disposed about the perimeter of the stone and with a perimeter portion of the girdle of the stone received in a groove within each of the prongs, the stone is secured.

In some embodiments, the first inner secondary prong and the first outer secondary prong of each side setting may be radially aligned, and the second inner secondary prong and the second outer secondary prong of each side setting may be radially aligned. However, other embodiments do not require any radial alignment between inner and outer secondary prongs. Optionally, within a given side setting, a radial angle between the first and second outer secondary prongs may be greater than the radial angle between the first and second inner secondary prongs. While the secondary prongs may be evenly spaced about a perimeter of the side stone, the spacing may vary. For example, the distance between the first and second inner secondary prongs may be less than the distance between any other pair of prongs within the side setting. In another example, the distance between the first inner secondary prong and the first outer secondary prong may be the same as the distance between the second inner secondary prong and the second outer secondary prong. Still further, the distance between the first and second outer secondary prongs may be greater than the distance between any other pair of prongs with the side setting.

In some embodiments, the first inner secondary prong and the first outer secondary prong of each side setting may be connected by a first rail. Similarly, the second inner secondary prong and the second outer secondary prong of each side setting may be connected by a second rail. Alternatively, the first outer secondary prong of each side setting may be connected to the ring-shaped base by a first rail and the second outer secondary prong of each side setting may be connected to the ring-shaped base by a second rail. In either case, a rail may be helpful to mechanically support and stabilize the outer secondary prong, which may be longer than the inner secondary prong as measured from the point of connection to the ring-shaped base and may be connected to the ring-shaped base at a different angle than the inner secondary prong. Furthermore, by virtue of their location about the perimeter edge of the jewelry item, the outer secondary prongs may be the most likely to be snagged, pulled or hit. The additional strength provided by the rail may prevent the outer secondary prongs from becoming broken, loose or bent. In one option, the first rail and the second rail of a side setting may be curved, arched, contoured or cupped to avoid contact with a pavilion of the side stone.

In some embodiments, the plurality of primary prongs may be arranged in a plurality of primary prong pairs, wherein each primary prong pair includes two primary prongs. The primary prongs of each primary prong pair may be immediately adjacent at the first axial elevation where they connect to the ring-shaped base and may diverge apart with distance from the ring-shaped base. The plurality of primary prong pairs preferably includes at least three primary prong pairs spaced out around the ring-shaped base.

In some embodiments, the first outer secondary prong of each side setting may form a V-shaped or branched double-prong with an adjacent one of the second outer secondary prongs of an adjacent one of the side settings. It is important to note that the two outer secondary prongs of the V-shaped double-prong are not in the same side setting. Rather, the V-shaped double-prong connects to the ring-shaped based at a midpoint between adjacent side settings, such that the V-shaped double prong avoids blocking light below at substantial portion of the pavilion of the stone including the culet of the stone. It should be recognized that the V-shaped or branched double-prong may also be curved upward whereas the two prongs of the double-prong diverge apart with distance from the ring-shaped base.

In some embodiments, the jewelry item is a ring that is wearable on a person's finger. Accordingly, the jewelry item may further include a band for wearing about a finger and a pair of shoulders extending from the shank of the band and supporting the ring-shaped base apart from the band. The shoulders preferably support the ring-shaped base by connecting with an underneath surface of the ring-shaped base. For example, a first shoulder may connect with the underneath surface of the ring-shaped base at a first point about the ring-shaped base, and a second shoulder may connect with the underneath surface of the ring-shaped base at a second point about the ring-shaped base. The first and second points may be at opposing ends of the ring-shaped base. The band and/or the shoulders may or may not form additional settings and/or stones received in the additional settings.

In some embodiments, the jewelry item is a ring that is wearable on a person's finger and the jewelry item may further include a plurality of struts extending from the ring-shaped base to the band between a pair of shoulders that extend from the shank of the band to support the ring-shaped base apart from the band. The plurality of struts may provide additional strength and stability to the ring-shaped base relative to the band. Specifically, the struts may provide lateral stability to the ring-shaped base, whereas the shoulders that are aligned with the band primarily provide longitudinal stability to the ring-shaped base. Furthermore, the struts may be provided in the form of a decorative structure, such as a basket.

In some embodiments, each primary and/or secondary prong may have a curvature. For example, each primary prong may have a concave-inward curvature that is concave toward the central axis. As another example, each outer secondary prong may have a concave-upward curvature that is concave in the upward axial direction (i.e., the same direction that the crown of the center stone faces). Preferably, the tips of all of the primary and secondary prongs have a similar angle or curvature, where the tips are that portion of the prongs that extends upward (distally) beyond the groove that is configured to secure the girdle of a stone.

In some embodiments, each primary and/or secondary prong may have at least a portion of the length of the prong has a girth that tapers with distance from the ring-shaped base. In other words, the prongs may have a greater girth or breadth near a point of connection with the ring-shaped base than the girth or breadth of the prong near the groove or tip of the prong. Furthermore, it is an optional feature that each of the primary prongs has an average girth that is greater than an average girth of the inner secondary prongs.

In some embodiments, the side settings may be configured to dispose the side stones at an angle relative to the center stone. For example, the center stone may be set so that the crown of the center stone faces upward in the same direction as the central axis, whereas the side stones may be set so that the crown of the side stones face upward and slightly outward.

In some embodiments, the plurality of side settings may be arranged for securing the equal plurality of side stones so that no part of any of the side stones has an axial elevation greater than the axial elevation of the girdle of the center stone.

Some embodiments provide a jewelry item comprising a ring-shaped base, a single center setting, a center stone, a plurality of side settings, and a plurality of side stones. The ring-shaped base has a central opening and a central axis. The single center setting includes a plurality of primary prongs, each primary prong extending from the ring-shaped base at a first axial elevation and a first radial distance from the central axis. The center stone is secured in a position that intersects the central axis by the plurality of primary prongs, wherein the center stone has a pavilion that extends into the central opening. The plurality of side settings is positioned around a perimeter of the center setting, wherein each side setting includes first and second adjacent inner secondary prongs and first and second adjacent outer secondary prongs. Each inner secondary prong extends from the ring-shaped base at a second axial elevation and a second radial distance from the central axis, and each of the outer secondary prongs extending from the ring-shaped base at a third axial elevation and a third radial distance from the central axis. The first axial elevation is greater than the second axial elevation, and the second axial elevation is greater than the third axial elevation. The jewelry item further includes a plurality of side stones, wherein each side stone is secured in one of the side settings.

In some embodiments, the center stone and each of the side stones are faceted stones. Optionally, the center stone and each of the side stones may include a girdle, a crown on one side of the girdle, and a pavilion on the opposite side of the girdle, wherein the pavilion forms a culet. However, the various stones may also include variety of shapes, sizes, proportions, and the like.

Some embodiments provide the advantage that the structure of the ring-shaped base and the structure of the primary and secondary prongs do not extend directly under the culet of the center stone or any of the culets of the side stones. In a preferred option, there is no metal or other structure along the central axis between a culet of the center stone and the band, and wherein there is no metal along a central axis of each side stone between a culet of each side stone and the band.

FIG. 1A is a perspective view of a jewelry item 10 according to some embodiments, in the form of a ring. The jewelry item 10 includes a center setting 20 and a plurality of side settings 30 disposed about a perimeter of the center setting 20. As shown, a center stones 12 (illustrated in dashed lines) is secured in the center setting 20 and fourteen side stones 14 (illustrated in dashed lines) are secured in the fourteen side settings 30. The arrangement of the side stone 14 about the perimeter of the center stone 12 may be referred to as a halo configuration. However, some embodiments may have side settings 30 around one or more portion of the perimeter of the center setting without being a continuous or regularly spaced group of side settings as shown. Where the jewelry item 10 is in the form of a ring, a band 16 is secured to the settings 20, 30.

The center setting 20 includes four pairs of primary prongs 22 securing the center stone 12. For example, a perimeter edge of the center stone 12 may form a girdle that is receive into a groove within each primary prong. Each side setting 30 includes two inner secondary prongs 32 and two outer secondary prongs 34. In a manner similar to the center stone 12, a perimeter edge of each side stone 14 may form a girdle that is receive into a groove within each secondary prong.

Figure 1B:
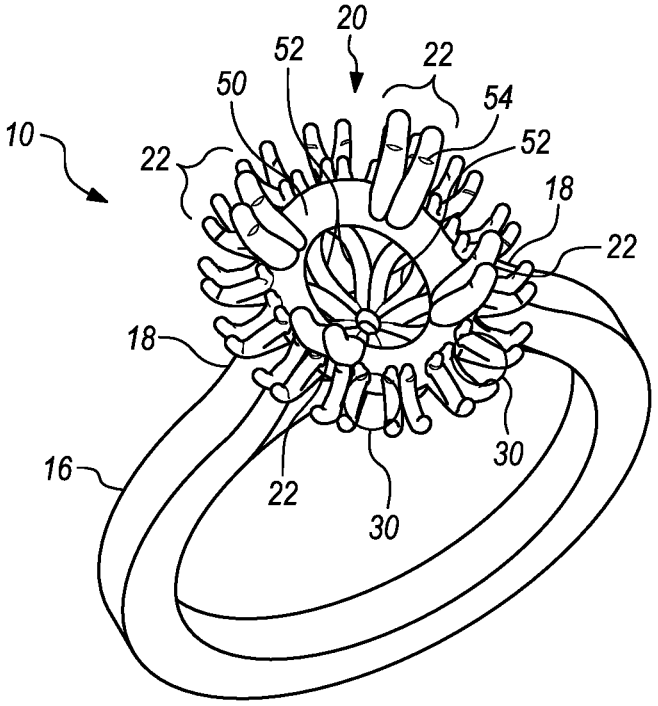
FIG. 1B is a perspective view of the jewelry item of FIG. 1A without the center stone or side stones.

FIG. 1B is a perspective view of the jewelry item 10 of FIG. 1A without the center stone or side stones secured in the settings. The jewelry item 10 includes a ring-shaped base 50 that is secured to the band 16 with a pair of shoulders 18 and one or more struts 52. While the shoulders 18 and struts 52 both support the ring-shaped base 50 a distance above the band 16, the shoulders 18 provide support primarily in a longitudinal direction (i.e., in the plane of the band 16) and the struts 52 may provide support in both the longitudinal direction and a lateral direction (i.e., in a plane that is perpendicular to the plane of the band 16). As shown, the struts 52 include six pairs of arched struts that form a decorate basket, while each strut has one end secured to the band 16 at the center of the center setting 20 and another end secured to the underneath side of the ring-shaped base 50.

Four pairs of primary prongs 22 are connected to the ring-shaped base 50 and extend upward (i.e., away from the band 16) from the ring-shaped base. The ring-shaped base 50 may follow any of a variety of paths, such as circular, oval and rectangular. However, the ring-shaped base 50 is illustrated with a generally circular path. The center setting 20 includes the four pairs of primary prongs 22, which provide a total of eight prongs. Each pair of primary prongs 22 may form a double-prong, where the base portions of the two prongs in the pair are connected together near their connection to the ring-shaped base. Alternatively, each pair of primary prongs 22 could be replaced with a single prong or the primary prongs in a pair may be independently connected to the ring-shaped base 50. Regardless of the exact number of primary prongs and regardless of whether or not the primary prongs are single or double prongs, the primary prongs are connected to the ring-shaped base 50 to form a center setting that is configured to secure a center stone. Each primary prong preferably includes a groove or notch 54 that opens toward the center of the setting 20 to receive an edge of the center stone. Where the center stone has a girdle, the grooves 54 may be sized and shaped to receive and secure the girdle.

In addition to the single center setting that includes the primary prongs, there are fourteen side settings 30 formed by the jewelry item 10. Each side setting 30 includes a first inner secondary prong, a second inner secondary prong, a first outer secondary prong and a second outer secondary prong. Each of the secondary prongs are connected to the ring-shaped base 50 as shown in greater detail in reference to FIG. 3C.

Figure 2:
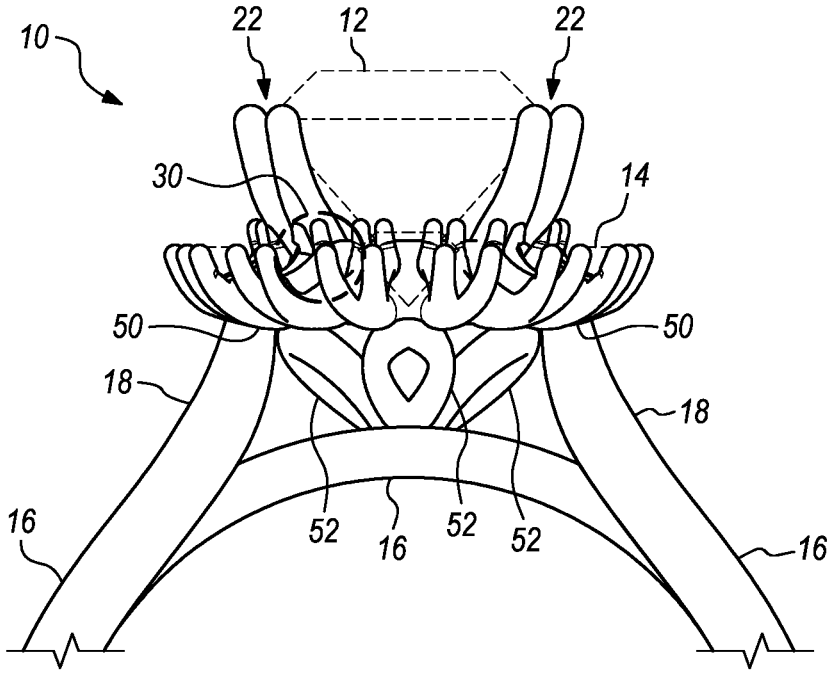
FIG. 2 is a side view of the jewelry item according to some embodiments.

FIG. 2 is a side view of the jewelry item 10 as shown in FIGS. 1A and 1B. First and second shoulders 18 are shown having a first end connected to the band 16. A middle portion of each shoulder 18 curves upward away from the band 16 to a second end that is connected to the ring-shaped base 50. Between the two shoulders 18, several struts 52 are illustrated. Each strut 52 has a first end connected to the band 16 between the shoulders 18 and a second end connected to the ring-shaped base 50. Separately and collectively, the shoulders 18 and the struts 52 support the ring-shaped base 50 away from the band 16 and provide longitudinal and lateral stability to the ring-shaped base 50 so that accidental bumps or tugs on the prongs or other elements of the jewelry item will not damage the structure or cause loosening or loss of any of the stones.

The pairs of primary prongs 22 are connected to the ring-shaped base 50 on an upper portion of the ring-shaped base 50, whereas the secondary prongs that form the side settings 30 are connected to the ring-shaped base 50 around the sides. Some of the side stones are not illustrated in order to show more detail about the side settings 30.

Figure 3A:
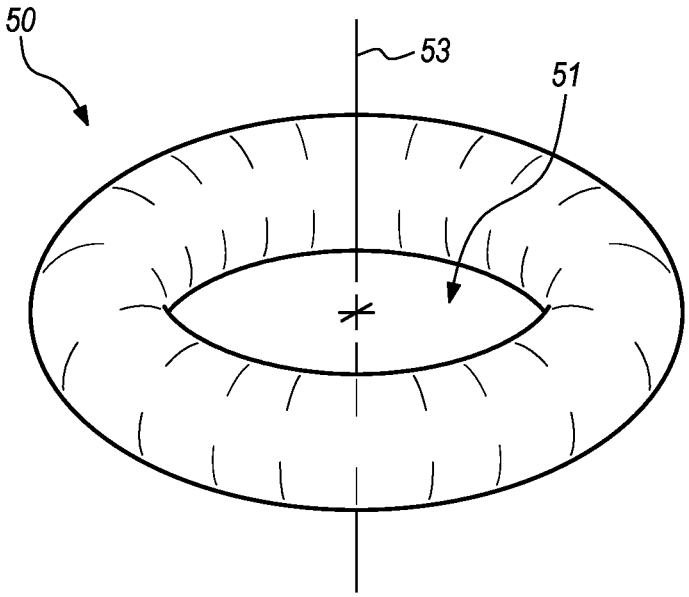
FIG. 3A is a perspective view of a ring-shaped base having a central opening and a central axis according to some embodiments.

FIG. 3A is a perspective view of a ring-shaped base 50 having a central opening 51 and a central axis 53 according to some embodiments. The ring-shaped base 50 provides support for the primary and secondary prongs (not shown; omitted for clarity), while the central opening 51 may receive the pavilion of the center stone and permits light to pass to and from the pavilion of the center stone. In embodiments where the ring-shaped base 50 follows a circular path (as would a toroidal base), the ring-shaped base may follow a given radius about the central axis 53. In embodiments where the ring-shaped base 50 follows an oval path, the central axis 53 may be located at the center of the oval, such as where the major axis of the oval and the minor axis of the oval cross. If the oval is generally planar, then the central axis of the oval would run through the center of the oval and extend perpendicular to the plane of the oval. The same procedure may be used to find the central axis of a ring-shaped base in the form of a rectangle.

Figure 3B:
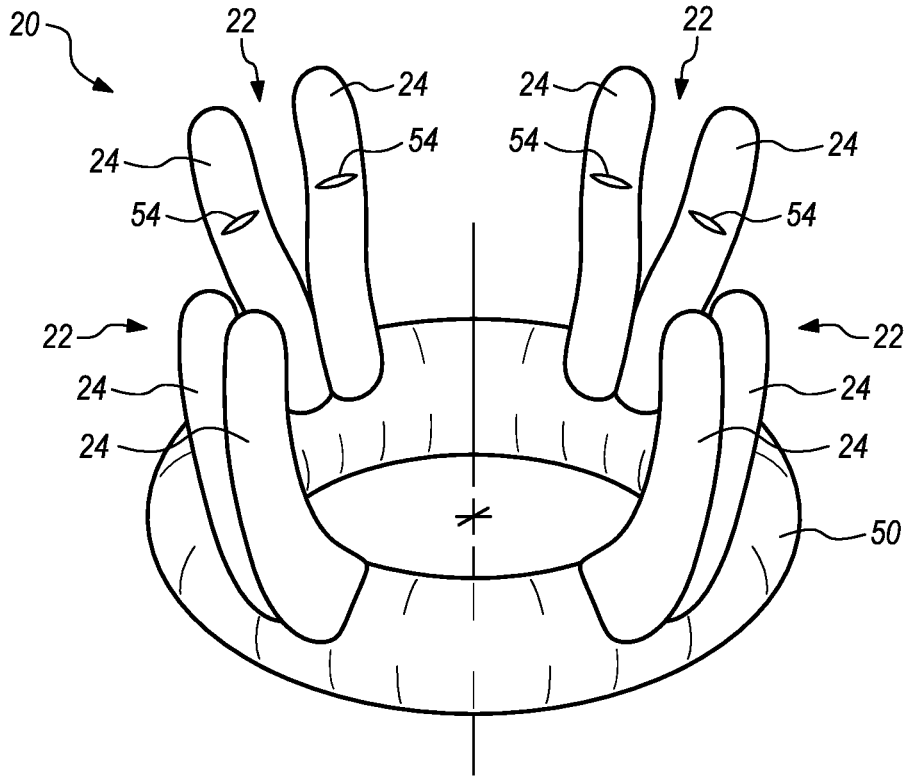
FIG. 3B is a perspective view of a plurality of primary prongs extending from the ring-shaped base to form a single center setting according to some embodiments.

FIG. 3B is a perspective view of a plurality of primary prong pairs 22 extending from the ring-shaped base 50 to form a single center setting 20 according to some embodiments. Each of the primary prong pairs 22 has two prongs 24 that are connected to an upper surface of the ring-shaped base 50. The two prongs 24 of a pair 22 are adjoined at the lower end or base where the prongs are connected to the ring-shaped base 50. Each prong 24 is illustrated having a taper over at least a portion of the length of the prong 24, such that the prong 24 is narrower at the top or tip than at the bottom or base end. Also, each prong 24 is illustrated having a groove or notch 54 that opens inward to receive a portion of the center stone, such as the girdle of a center stone.

Figure 3C:
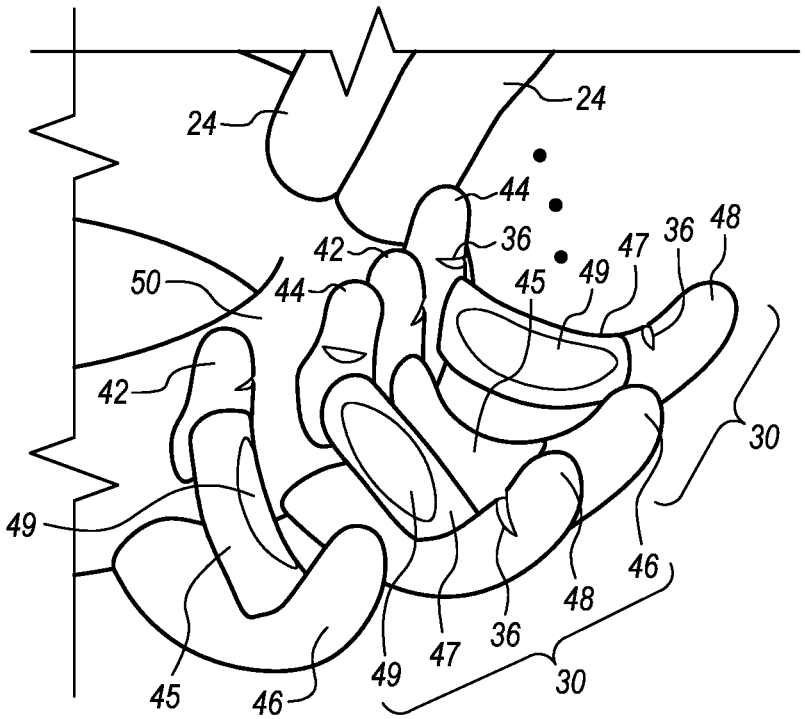
FIG. 3C is a perspective view of a plurality of side settings secured around a perimeter of the ring-shaped base according to some embodiments.

FIG. 3C is a perspective view of a plurality of side settings 30 secured around a perimeter of the ring-shaped base 50 according to some embodiments. While FIG. 3A showed only the ring-shaped base 50 and FIG. 3B showed the ring-shaped base 50 with only the primary prongs 24, FIG. 3C now shows the ring-shaped base 50 with both the primary prongs 24 of the center setting 20 and the secondary prongs of the side settings 30. While only two side settings 30 are shown, such side settings may be provided around some or all of the perimeter of the ring-shaped base 50 (see FIGS. 1A, 1B and 2). In some embodiments, the side settings 30 may be evenly spaced about the perimeter of the ring-shaped base 50 and form a continuous ring or halo around the center setting 20.

Each side setting 30 includes a first inner secondary prong 42, a second inner secondary prong 44, a first outer secondary prong 46 and a second outer secondary prong 48. These secondary prongs 42, 44, 46, 48 collectively form a side setting 30 and work together to secure a side stone (not shown; see side stones 14 in FIGS. 1A and 2). Each of the four secondary prongs 42, 44, 46, 48 has a groove or notch 36 in the side of the prong for receiving and securing a portion of the side stone, such as a girdle of a side stone.

In the embodiment shown, the first and second inner secondary prongs 42, 44 are connected to the ring-shaped base 50 along a perimeter surface at an elevation that is higher than an elevation at which the first and second outer secondary prongs 46, 48 are connected to the ring-shaped base 50. Accordingly, the first and second inner secondary prongs 42, 44 may be shorter than the first and second outer secondary prongs 46, 48 which are connected to the ring-shaped base 50 at a lower elevation and curve outward and upward. Due to the length and curvature of the outer secondary prongs 46, 48, and also due to the greater potential for being accidentally hit or snagged while being worn by a person, the first inner secondary prong 42 may be connected to the first outer secondary prong 46 by a first rail 45 and the second inner secondary prong 44 may be connected to the second outer secondary prong 48 by a second rail 47. Optionally, the rails 45, 47 may be partially or entirely connected directly to the ring-shaped base 50. In either option, the rails 45, 47 extend to the respective outer secondary prongs 46, 48 at an elevation that will be below the elevation of the grooves or notches 36 that establish the elevation of the side stone to be received in the side setting 30. The rails 45, 47 preferably extend to the respective outer secondary prongs 46, 48 at an elevation that is along side a pavilion of the side stone. Optionally, the rails 45, 47 may be designed to make additional room for the side stone, and perhaps avoid contact with the side stone, by having a surface 49 that is contoured, scooped or cupped in an upward and inward direction relative to the side setting 30. Most preferably, the surface 49 may have a shape that is the complement of the side stone to be received in the side setting.

Figure 4:
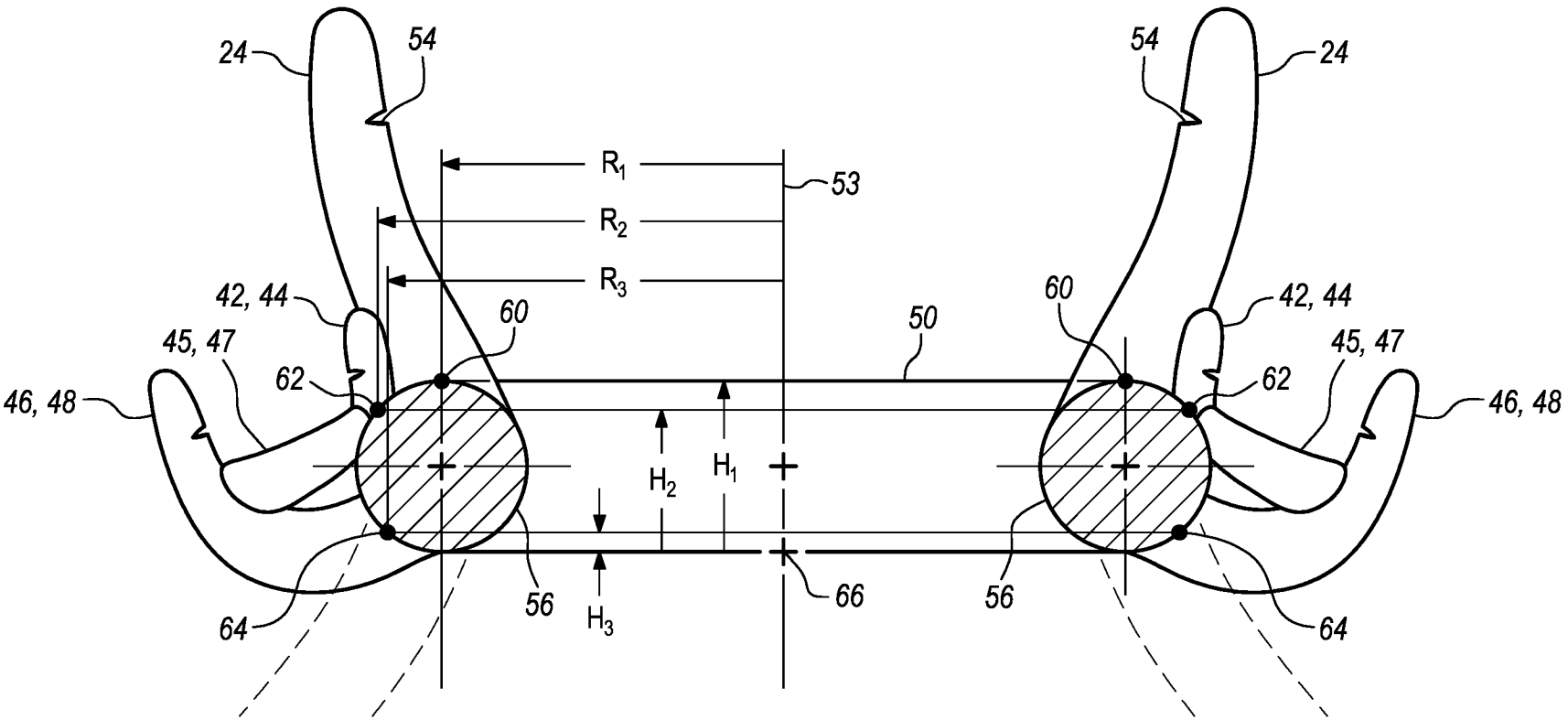
FIG. 4 is a schematic cross-sectional diagram illustrating the relative positioning of the primary prongs, the inner secondary prongs and the outer secondary prongs about the perimeter of a cross-section of the ring-shaped base according to some embodiments.

FIG. 4 is a schematic cross-sectional diagram illustrating the relative positioning of the primary prongs 24, the inner secondary prongs 42, 44 and the outer secondary prongs 46, 48 about the perimeter of a cross-section of the ring-shaped base 50 according to some embodiments. While the ring-shaped base 50 has a perimeter as shown in FIG. 3A, FIG. 4 illustrates a cross-section of the ring-shaped base 50 taken along a plane that includes the central axis 53. The plane cuts through the ring-shaped base 50 to show the cross-section 56.

While each prong has a girth, a center point of that girth may be used as a point of reference for describing where the prong is connected to the ring-shaped base 50. Accordingly, the primary prongs 24 may be described as being connected to the ring-shaped base 50 at connection points 60 about the cross-section 56, the inner secondary prongs 42, 44 may be described as being connected to the ring-shaped base 50 at connection points 62 about the cross-section 56, and the outer secondary prongs 46, 48 may be described as being connected to the ring-shaped base 50 at connection points 64 about the cross-section 56. In reference to the central axis 53 and a reference point 66 where the central axis 53 crosses the lower edge of the ring-shaped base 50, the locations of the connection points 60, 62, 64 may each be separately described by an axial elevation (i.e., a distance along the central axis 53 above the reference point 66) and a radial distance from the central axis 53. As shown, the connection point 60 has an axial elevation of H1 (height 1) and a radial distance of R1 (radius 1), the connection point 62 has an axial elevation of H2 (height 2) and a radial distance of R2 (radius 2), and the connection point 64 has an axial elevation of H3 (height 3) and a radial distance of R3 (radius 3).

In some embodiments, each primary prong 24 extends from the ring-shaped base 50 at a first axial elevation (H1) and a first radial distance (R1) from the central axis 53; each inner secondary prong 42, 44 extends from the ring-shaped base at a second axial elevation (H2) and a second radial distance (R2) from the central axis 53; and each of the outer secondary prongs 46, 48 extends from the ring-shaped base 50 at a third axial elevation (H3) and a third radial distance (R3) from the central axis 53. In the embodiment illustrated in FIG. 4, the first axial elevation (H1) is greater than the second axial elevation (H2), and wherein the second axial elevation (H2) is greater than the third axial elevation (H3). Furthermore, FIG. 4 illustrates the second radial distance (R2) and the third radial distance (R3) being greater than the first radial distance (R1). In some embodiments, each of the primary prongs 54 are connected to the ring-shaped base 50 at the same location (H1, R1) about the cross-section 56, each of the inner secondary prongs 42, 44 are connected to the ring-shaped base 50 at the same location (H2, R2), and each of the outer secondary prongs 46, 48 are connected to the ring-shaped base 50 at the same location (H3, R3).

Figure 5:
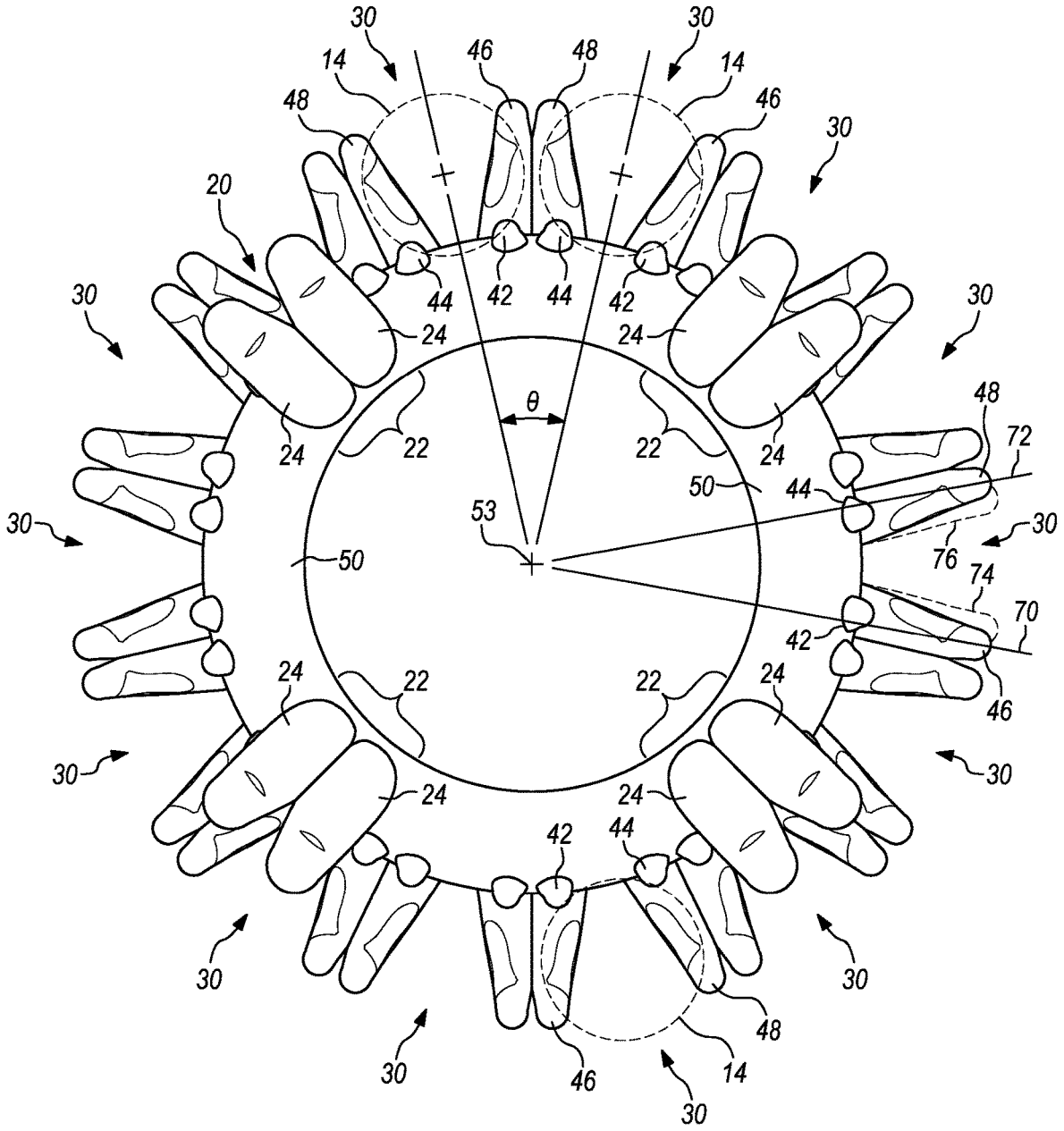
FIG. 5 is a schematic top view illustrating the relative angular positioning of the primary prongs, the inner secondary prongs and the outer secondary prongs about the central axis of the ring-shaped base according to some embodiments.

FIG. 5 is a schematic top view of the jewelry item 10 illustrating the relative angular positioning of the primary prongs 24, the inner secondary prongs 42, 44 and the outer secondary prongs 46, 48 about the central axis 53 of the ring-shaped base 50 according to some embodiments. The primary prongs 24 are arranged in pairs 22, which are generally equally spaced about the central axis 53 to form the center setting 20. More specifically, the illustrated embodiment has eight (8) primary prongs 24 forming four (4) pairs 22 that are spread about the ring-shaped base 50 are roughly equal angular locations about 90 degrees apart from a center of each adjacent pair 22. The primary prong pairs 22 are shown positioned at angular locations of 45, 135, 225 and 315 degrees, but could also be positioned at angular locations of 0, 90, 180 and 270. Still further, the angular locations may be irregularly spaced, the primary prongs may be separated (i.e., no pairs), and/or the number of primary prongs may vary.

The jewelry item 10 further includes a plurality of side settings 30. In the illustrated embodiment, there are fourteen (14) side settings 30 that are positioned at roughly equal angular locations (i.e., about 16 degrees between each side setting) about the central axis 53 of the ring-shaped base 50. Each side setting 30 includes a first inner secondary prong 42, a second inner secondary prong 44, a first outer secondary prong 46, and a second outer secondary prong 48. The secondary prongs 42, 44, 46, 48 of a given side setting 30 are configured to secure a side stone 14 (only three shown in dashed lines). For example, each of the secondary prongs 42, 44, 46, 48 of a given side setting 30 may include a groove or notch 36 (see FIG. 3C) to receive and secure a portion of the side stone, such as a girdle of the side stone.

In one option, the first inner secondary prong 42 may be radially aligned with the first outer secondary prong 46 (see radial line 70) and/or the second inner secondary prong 44 may be radially aligned with the second outer secondary prong 48 (see radial line 72). However, the inner and outer prongs may not be radially aligned and may be arranged in other manners, such as forming the corners of a rectangular arrangement. Such a rectangular arrangement or other suitable arrangement may be accomplished by moving the outer secondary prongs 46, 48 to the positions 74, 76 (shown in dashed lines), respectively. The arrangement of the outer secondary prongs 46, 48 at the positions 74, 76 may provide better support and security for the side stone that is secured in the side setting 30.

Figure 6:
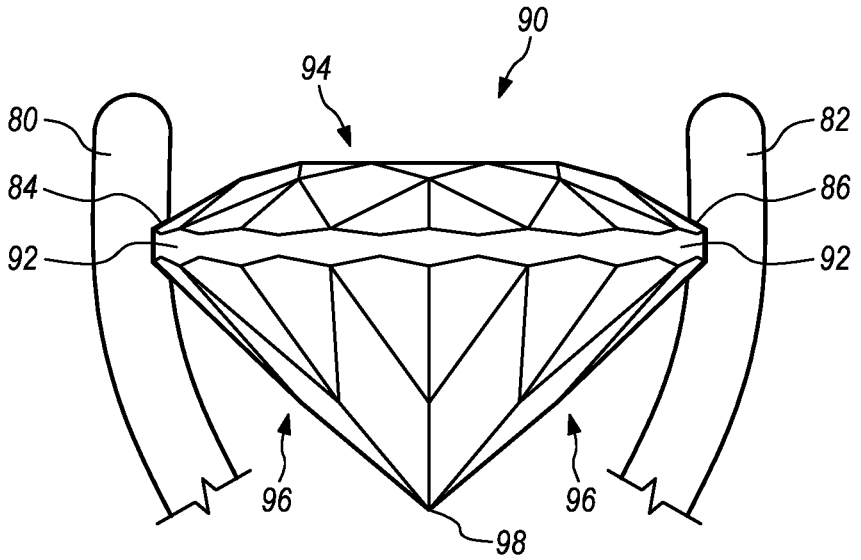
FIG. 6 is a schematic side view of prongs having grooves for receiving and securing the girdle of a faceted stone.

FIG. 6 is a schematic side view of two prongs 80, 82 having grooves 84, 86 for receiving and securing the girdle 92 of a faceted stone 90. In an actually setting, there would be three or more prongs. The illustrated stone 90 further defines a crown 94 above the girdle 92 and a pavilion 96 below the girdle 92. A culet 98 is the point at the lower end of the pavilion 96. Some embodiments are not limited to a stone of this type and shape, but this stone is just one example of a suitable stone that may be secured in a setting of some embodiments. The illustration of FIG. 6 may be representative of the center setting 20 and center stone 12 shown in FIGS. 1 and 2, but it may also be representative of a side setting 30 and a side stone 14 shown in FIGS. 1, 2 and 5.

Figure 7A:
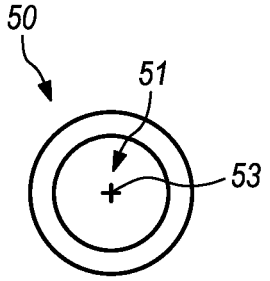
FIGS. 7A, 7B, and 7C are schematic top views of a ring-shaped base in the form of a circle, oval and rectangle, respectively.
Figure 7B:
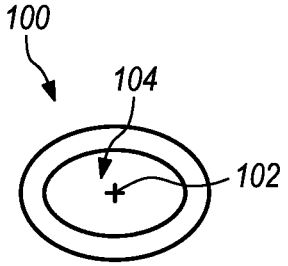
Figure 7C:
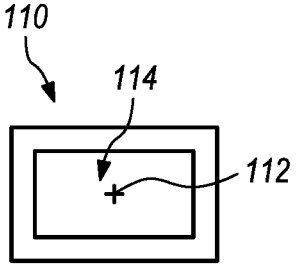

FIGS. 7A, 7B, and 7C are schematic top views of a ring-shaped base in the form of a circle, oval and rectangle, respectively. The circular ring-shaped base 50 shown in FIG. 7A has a central opening 51 and a central axis 53 as shown in previous Figures. FIG. 7B illustrates a ring-shaped base in the form of an oval and having a central axis 102 and a central opening 104. FIG. 7C illustrates a ring-shaped base in the form of a rectangle and having a central axis 112 and a central opening 114.

Figure 8A:
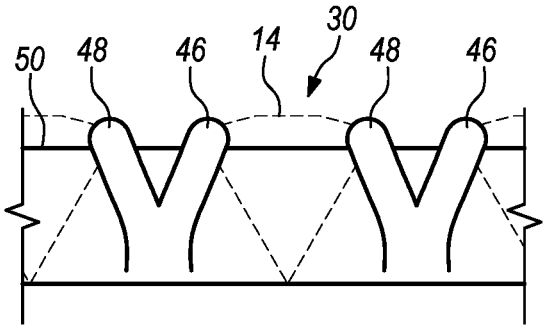
FIG. 8A is a partial side view of a ring-shaped base with a first outer secondary prong and a second outer secondary prong forming a V-shaped or branched prong.

FIG. 8A is a partial side view of a ring-shaped base 50 with a first outer secondary prong 46 and a second outer secondary prong 48 forming a V-shaped or branched prong. The branched prong include the distal ends of the first and second outer secondary prongs 46, 48, but the first and second outer secondary prongs 46, 48 merge together and have a single connection to the ring-shaped base 50. This allows for fewer total connections, a connection having a broader girth than could be accommodated for each separate prong, and directing the lower portion of the combined prong between the areas where adjacent side stones will be positioned. Accordingly, the first and second outer secondary prongs 46, 48 may be positioned as necessary to securely support the side stones of their respective side settings 30, yet the lower portion of the combined prong passes between the side stones and reduces the extent to the outer prongs block light to and from the side stone 14. Note that the first and second outer secondary prongs 46, 48 which a single combined prong are not in the same side setting 30.

Figure 8B:
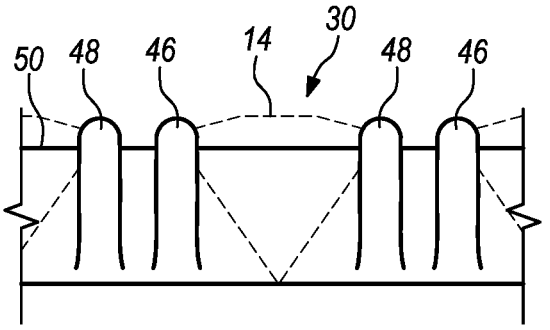
FIG. 8B is a partial side view of a ring-shaped base with a first outer secondary prong and a second outer secondary prong forming separate connections to the ring-shaped base.

FIG. 8B is a partial side view of a ring-shaped base 50 with a first outer secondary prong 46 and a second outer secondary prong 48 forming separate connections to the ring-shaped base 50. This may simplify the geometry and construction of the prongs 46, 48, but requires additional connections and may block more light from passing to and from the side stone 14.

The terminology used herein is for the purpose of describing particular embodiments only and is not intended to limit the scope of the claims. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the embodiment.

The corresponding structures, materials, acts, and equivalents of all means or steps plus function elements in the claims below are intended to include any structure, material, or act for performing the function in combination with other claimed elements as specifically claimed. Embodiments have been presented for purposes of illustration and description, but it is not intended to be exhaustive or limited to the embodiments in the form disclosed. Many modifications and variations will be apparent to those of ordinary skill in the art after reading this disclosure. The disclosed embodiments were chosen and described as non-limiting examples to enable others of ordinary skill in the art to understand these embodiments and other embodiments involving modifications suited to a particular implementation.

What is claimed is:

1. A jewelry item, comprising:

a ring-shaped base having a central opening and a central axis;

a single center setting for securing a center stone, wherein the single center setting includes a plurality of primary prongs, each primary prong extending from the ring-shaped base at a first axial elevation and a first radial distance from the central axis, wherein the plurality of primary prongs are positioned to collectively secure the center stone in a position that intersects the central axis;

a plurality of side settings secured around a perimeter of the ring-shaped base for securing an equal plurality of side stones around a perimeter of the center setting, wherein each side setting includes first and second adjacent inner secondary prongs and first and second adjacent outer secondary prongs, each inner secondary prong extending from the ring-shaped base at a second axial elevation and a second radial distance from the central axis, and each of the outer secondary prongs extending from the ring-shaped base at a third axial elevation and a third radial distance from the central axis, wherein the first axial elevation is greater than the second axial elevation, and wherein the second axial elevation is greater than the third axial elevation.

2. The jewelry item of claim 1, wherein each primary prong has a groove positioned for receiving a portion of a girdle of the center stone, and wherein each of the inner secondary prongs and each of the outer secondary prongs has a groove for receiving a portion of a girdle of one of the side stones.

3. The jewelry item of claim 1, wherein the first inner secondary prong and the first outer secondary prong of each side setting are radially aligned, and wherein the second inner secondary prong and the second outer secondary prong of each side setting are radially aligned.

4. The jewelry item of claim 1, wherein the first inner secondary prong and the first outer secondary prong of each side setting are connected by a first rail, and wherein the second inner secondary prong and the second outer secondary prong of each side setting are connected by a second rail.

5. The jewelry item of claim 4, wherein the first rail and the second rail are contoured to avoid contact with a pavilion of the side stones.

6. The jewelry item of claim 1, wherein the plurality of primary prongs are arranged in a plurality of primary prong pairs, wherein each primary prong pair includes two primary prongs that are immediately adjacent at the first axial elevation and diverge apart, wherein the plurality of primary prong pairs include at least three primary prong pairs spaced out around the ring-shaped base.

7. The jewelry item of claim 1, wherein the first outer secondary prong of each side setting form a V-shaped double-prong with an adjacent one of the second outer secondary prongs of an adjacent one of the side settings.

8. The jewelry item of claim 1, wherein the plurality of side settings is arranged to secure a plurality of side stones in a halo configuration about the plurality of primary prongs that collectively secure the center stone.

9. The jewelry item of claim 1, wherein the plurality of side settings are arranged for securing the equal plurality of side stones so that no part of any of the side stones has an axial elevation greater than the axial elevation of the girdle of the center stone.

10. The jewelry setting of claim 1, further comprising:

a band for wearing about a finger; and a pair of shoulders extending from a shank of the band and supporting the ring-shaped base apart from the band.

11. The jewelry item of claim 10, further comprising:

a plurality of struts extending from the ring-shaped base to the band between the pair of shoulders.

12. The jewelry item of claim 1, wherein each prong has concave-inward and/or concave-upward curvature within a radial plane relative to the central axis.

13. The jewelry item of claim 1, wherein at least a portion of the length of each prong has a girth that tapers with distance from the ring-shaped base.

14. The jewelry item of claim 1, wherein each of the primary prongs has an average girth that is greater than an average girth of the inner secondary prongs.

15. The jewelry item of claim 1, wherein the ring-shaped base forms an oval or a circle.

16. The jewelry item of claim 1, wherein the ring-shaped seat is a toroidal shape having a circular cross-section profile in a radial plane relative to the central axis.

17. The jewelry item of claim 1, wherein the plurality of side stones are securable in the plurality of side settings without the ring-shaped base or the secondary prongs extending directly under a culet of any of the side stones.

18. A jewelry item, comprising:

a ring-shaped base having a central opening and a central axis;

a single center setting including a plurality of primary prongs, each primary prong extending from the ring-shaped base at a first axial elevation and a first radial distance from the central axis;

a center stone secured in a position that intersects the central axis by the plurality of primary prongs, wherein the center stone has a pavilion that extends into the central opening;

a plurality of side settings secured around a perimeter of the ring-shaped base and positioned around a perimeter of the center setting, wherein each side setting includes first and second adjacent inner secondary prongs and first and second adjacent outer secondary prongs, each inner secondary prong extending from the ring-shaped base at a second axial elevation and a second radial distance from the central axis, and each of the outer secondary prongs extending from the ring-shaped base at a third axial elevation and a third radial distance from the central axis, wherein the first axial elevation is greater than the second axial elevation, and wherein the second axial elevation is greater than the third axial elevation; and a plurality of side stones, each side stone secured in one of the side settings.

19. The jewelry item of claim 18, wherein the center stone and each of the side stones includes a girdle, a crown on one side of the girdle, and a pavilion on the opposite side of the girdle, wherein the pavilion forms a culet.

20. The jewelry item of claim 19, wherein there is no metal along the central axis between a culet of the center stone and the band, and wherein there is no metal along a central axis of each side stone below a culet of each side stone.

* * * * *